United States Patent [19]

King

[11] Patent Number: 4,748,377

[45] Date of Patent: May 31, 1988

[54] TRAVELLING WAVE TUBES

[75] Inventor: Robin C. M. King, Ongar, England

[73] Assignee: English Electric Valve Company Limited, Chelmsford, England

[21] Appl. No.: 852,745

[22] Filed: Apr. 16, 1986

[30] Foreign Application Priority Data

Apr. 24, 1985 [GB] United Kingdom ..... 8510444
Mar. 11, 1986 [GB] United Kingdom ..... 8605950

[51] Int. Cl.[4] ..... H01J 25/34
[52] U.S. Cl. ..... 315/3.5; 315/39.3; 315/50; 315/112; 313/22; 313/36; 313/44
[58] Field of Search ..... 313/17, 22, 30, 36, 313/45; 315/3.5, 3.6, 5.39, 39.3, 50

[56] References Cited

U.S. PATENT DOCUMENTS

| | | | |
|---|---|---|---|
| 3,412,279 | 11/1968 | Allen et al. | 315/3.5 |
| 3,678,327 | 7/1972 | Schmidt | 315/5.39 |
| 4,057,748 | 11/1977 | Davis | 315/3.5 |
| 4,103,207 | 7/1978 | Chaffee | 315/3.5 |
| 4,471,266 | 9/1984 | Fleury et al. | 315/3.5 |

*Primary Examiner*—Saxfield Chatmon
*Assistant Examiner*—Mark R. Powell
*Attorney, Agent, or Firm*—Spencer & Frank

[57] ABSTRACT

A coupled cavity travelling wave tube has a coupling wall/ferro-magnetic pole piece formed as an iron-copper-iron sandwich with a coolant channel therein defined at least in part by the inner copper member of the sandwich. Where the coolant channel is defined also in part by a surface of an outer ferromagnetic member, at least that surface is electroplated.

20 Claims, 2 Drawing Sheets

TRAVELLING WAVE TUBES

BACKGROUND OF THE INVENTION

This invention relates to travelling wave tubes and in particular to coupled cavity travelling wave tubes.

Coupled cavity travelling wave tubes are commonly formed with coupling plates defining the ends of each cavity which act also as ferro-magnetic pole pieces.

It is important that the coupling plates/pole pieces exhibit good heat conduction in order that the heat generated in the region of the beam coupling hole in each be conducted away. However, the materials which must be used for their magnetic function (e.g. iron) are not generally ideal heat conductors and for this reason it is common to provide some means of enhancing heat conduction from the beam coupling hole outwardly. Such means as presently known include the use of a copper insert in the pole piece or the formation of the pole piece by an iron-copper-iron laminate.

Another approach is to provide a water passage through the coupling plate/pole piece. This may be achieved as illustrated in FIG. 1 of the accompanying drawings.

Referring to FIG. 1, this shows, part brokenaway, a section through a coupling plate/pole piece taken transversely of the tube axis 1. The coupling plate or pole piece consists of a circular disc 2 having a central beam hole 3. In this example the beam hole 3 is surrounded by a drift tube 4 as known per se. The disc 2 is formed in two parts, both of iron, one part referenced 5 in which a water channel 6 is formed in its surface and the other part, referenced 7 being provided to act as a closure for the water channel 6. Water manifolding, not shown, is provided at convenient locations in order to enable water, or of course other coolants, to be passed through the channel 6. Viewed in the direction of the axis 1, water channel 6 would be arcuate in shape.

Because of the corrosive effects of water passing through channel 6 it is necessary to protect the iron surfaces of the parts 5 and 7 defining the water passage 6. Typically therefore the facing surfaces at least of the parts 5 and 6 would be electro-plated (e.g. with nickel) but, because of the recessed nature of the channel portion formed in the part 5 the use of an electroless plating process is called for.

In order to improve the temperature distribution around the inner surface of the beam hole 3, a cylindrical copper liner represented in dashed outline at 8 in FIG. 1 is sometimes provided. The liner 8 tends to provide compensation for the heat conduction distorting effects of the impedance to heat conduction presented by the normally provided coupling slot which is not shown in FIG. 1 since it is located beyond the point at which the disc 2 is shown broken away. The coupling hole referred to will be similar to that represented at 12 in FIG. 3, to be described later. As will be appreciated, this impedance effects one sector of the disc 2 rather than the disc uniformly.

SUMMARY OF THE INVENTION

The present invention seeks to provide an improved coupled cavity travelling wave tube in which a coupling plate defining the end of a cavity and acting also as a ferro-magnetic pole piece, is water cooled.

According to this invention a coupled cavity travelling wave tube is provided in which a coupling plate defining the end of a cavity acts also as a magnetic pole piece, said coupling plate/magnetic pole piece being of sandwich construction with outer constituent members of ferro-magnetic material and an inner member of a material resistant to coolant-induced corrosion and having a heat conductivity greater than that of said ferro-magnetic material, said inner member defining, at least in part, the walls of a coolant channel within said coupling wall/ pole piece.

Preferably said inner member is of copper and may be of unitary form or formed of more than one section.

In one embodiment of the invention said coolant channel is rectangular in cross-section with two facing walls formed by said inner member and the remaining facing walls formed one by one outer constituent part and the other by the other.

Preferably said inner member extends radially inwards to form part of the wall of a beam hole extending axially through said coupling wall/pole piece.

Where said coupling wall/pole piece is formed with a drift tube extending said beam hole in an axial direction, preferably the part of said drift tube extending in one axial direction is formed as part of one of said outer constituent members and the part of the drift tube extending in the opposite axial direction is formed as part of the other outer constituent member.

Said beam hole may be lined with a cylindrical liner of a material of good heat conductivity, normally copper, whereby to distribute heat around said beam hole.

In one embodiment of the invention in which said beam hole is lined with a cylindrical liner said cylindrical liner is a unitary liner extending through said outer constitute members and said inner member.

In another embodiment of the invention in which said beam hole is lined with a cylindrical liner, said cylindrical liner comprises two sections, one extending through one of said outer constituent members and the other through the other, said inner member extending beyond said constituent members by the thickness of said cylindrical liner.

Where said coolant channel is defined in part by a surface of an outer constituent member, normally at least that surface will be protected by electro-plating, e.g. with nickel.

DESCRIPTION OF THE PREFERRED EMBODIMENTS

None of the FIGS. 2 to 5 are intended to represent the proportions of the tube with accuracy.

In all Figures, like references are used for like parts.

Figure 1:
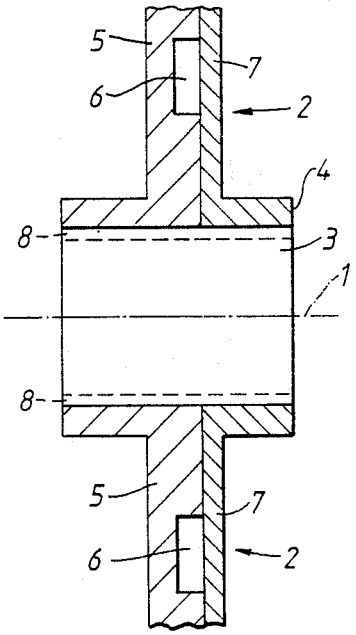
FIG. 1. PRIOR ART
FIG. 1 shows a section through one coupling plate/-pole piece of a known coupled cavity travelling wave tube.
Figure 2:
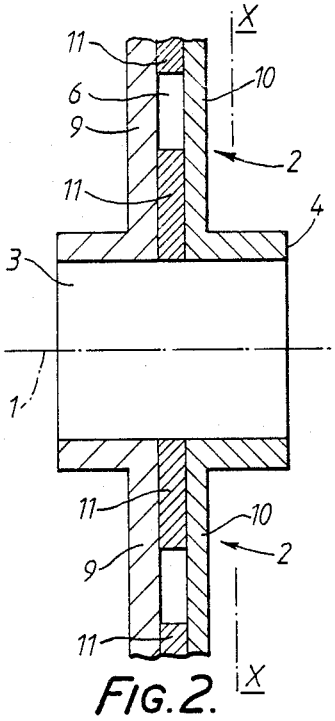
FIG. 2 shows, part broken-away, a section through one coupling plate/pole piece of an example of coupled cavity travelling wave tube in accordance with the present invention.
Figure 3:
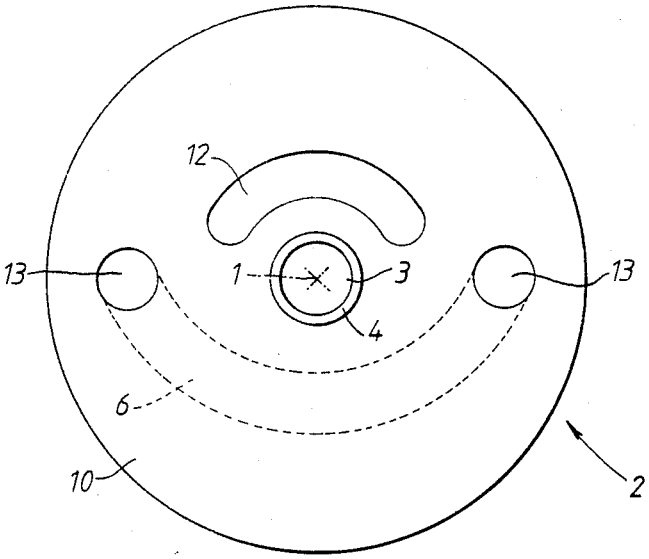
FIG. 3 (which is not to the same scale as FIG. 2) shows a transverse section along the line X—X of FIG. 2.

Referring to FIGS. 2 and 3, in which like references are used to denote like parts in FIG. 1, in this case the coupling plate/pole piece 2 is of a sandwich construction with outer ferro-magnetic constituent members 9, 10 and an inner member 11 of copper.

Outer member 10 is provided to form one part of the drift tube 4 extending axially to the right as viewed whilst outer constituent member 9 is provided to form part of the drift tube 4 extending axially to the left as viewed.

The inner copper member 11 in this case is a unitary member in the form of a disc having an arcuate slot for defining the water passage 6. The water passage 6 is completed by the facing surfaces of the outer constituent members 9 and 10, which surfaces, at least are electro-plated with nickel. It will be noted that the plating process in this case does not call for the use of an electroless plating process since the surfaces to be plated do not feature recesses.

It will be noted that inner copper member 11 extends radially inwardly towards the axis 1 of the tube to form part of the inner surface of the beam hole passing through the drift tube 4. This in itself aids the conduction of heat away from the region of the beam hole to the coolant water passage 6.

In FIG. 3, the usual coupling slot (not shown in FIGS. 1 or 2) is represented at 12. Inlet and outlet parts for the channel 6 (represented in dashed line in FIG. 3) are represented at 13.

Whilst not shown, it will be appreciated that rather than being formed as a slot in the inner member 11, the water passage 6 could be defined by means of a recess in the copper member so that three walls of the channel are formed by the copper material of the inner member. Again whilst not illustrated, in addition a copper disc may be interposed between the copper inner member 11 and that one of the outer constituent members 9 and 10 which would otherwise close off the channel 6 in order to avoid any contact between the coolant in the channel 6 and ferro-magnetic material. Indeed as a simple modification to the arrangement shown in FIG. 2 copper discs may be introduced on either side of inner member 11 so that all four walls of the channel 6 are formed of copper material, rather than define the passage by means of a recess.

Figure 4:
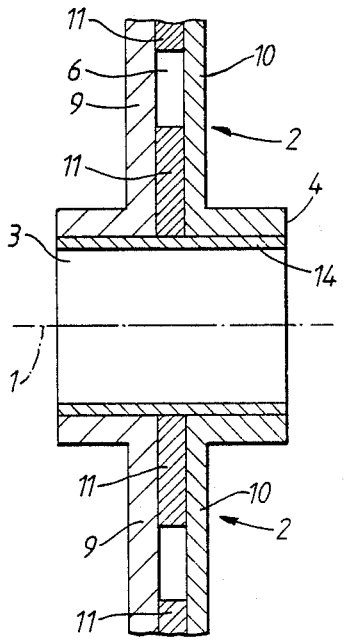
FIG. 4 illustrates a modification of the invention.

Referring to FIG. 4, it will be seen that the embodiment illustrated is substantially similar to that illustrated in FIGS. 2 and 3 except that the beam hole 3 is lined with a cylindrical liner 14 of copper which acts to distribute heat around beam hole 3, thus tending to compensate for the heat conduction distorting effects of the coupling hole 12 (FIG. 3), the impedance of which effects one sector of the disc 2 rather than the disc uniformly. Liner 14 is in contact with inner member 11 which ends flush with the wall of the hole 3 through members 9, 10.

Figure 5:
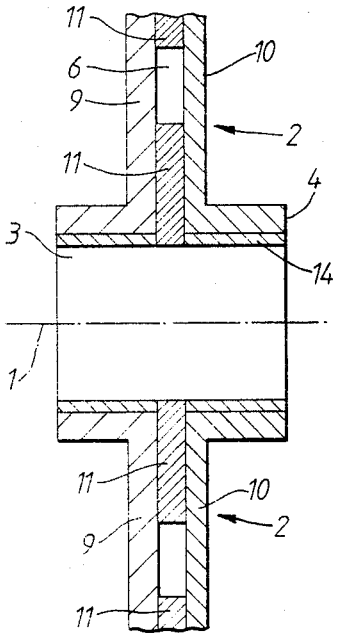
FIG. 5 illustrates a further modification.

Referring to FIG. 5, the embodiment illustrated is essentially similar to that illustrated in FIG. 4 save that inner member 11 protrudes from the wall of the hole 3 through members 9, 10 by the thickness of liner 14 and liner 14 is provided in two sections, one on either side of the inner member 11.

What is claimed is:

1. A coupled cavity travelling wave tube in which a coupling plate defining the end of a cavity acts also as a magnetic pole piece, said coupling plate/magnetic pole piece being of sandwich construction with outer constituent members of ferro-magnetic material and an inner member of a material resistant to coolant-induced corrosion and having a heat conductivity greater than that of said ferro-magnetic material, said inner member defining, at least in part, the walls of a coolant channel within said coupling wall/pole piece.

2. A tube as claimed in claim 1 and wherein said inner member is made of copper.

3. A tube as claimed in claim 1 and wherein said inner member is of unitary form.

4. A tube as claimed in claim 1 and wherein said inner member is formed of more than one section.

5. A tube as claimed in claim 1 and wherein said coolant channel is rectangular in cross-section with two facing walls formed by said inner member and the remaining facing walls formed one by one outer constituent member and the other by the other constituent member.

6. A tube as claimed in claim 1 and wherein said inner member extends radially inwards to form part of the wall of a beam hole extending axially through said coupling wall/pole piece.

7. A tube as claimed in claim 1 wherein said coupling wall/pole piece is formed with a drift tube extending said beam hole in an axial direction and wherein the part of said drift tube extending in one axial direction is formed as part of one of said outer constituent members and the part of the drift tube extending in the opposite axial direction is formed as part of the other outer constituent member.

8. A tube as claimed in claim 6 wherein said beam hole is lined with a cylindrical liner of a material of good heat conductivity whereby to distribute heat around said beam hole.

9. A tube as claimed in claim 8 and wherein said last-mentioned material is copper.

10. A tube as claimed in claim 8 and wherein said cylindrical liner is a unitary liner extending through said outer constituent member and said inner member.

11. A tube as claimed in claim 8 and wherein said cylindrical liner comprises two sections, one extending through one of said outer constituent members and the other through the other, said inner member extending beyond said constituent member by the thickness of said cylindrical liner.

12. A tube as claimed in claim 1 wherein said coolant channel is defined in part by a surface of an outer constituent member and wherein at least that surface is protected by electro-plating.

13. A tube as claimed in claim 7 and wherein said beam hole is lined with a cylindrical liner of a material of good heat conductivity whereby to distribute heat around said beam hole.

14. A tube as claimed in claim 13 and wherein said last-mentioned material is copper.

15. A tube as claimed in claim 13 and wherein said cylindrical liner is a unitary liner extending through said outer constituent member and said inner member.

16. A tube as claimed in claim 13 and wherein said cylindrical liner comprises two sections, one extending through one of said outer constituent members and the other through the other, said inner member extending beyond said constituent member by the thickness of said cylindrical liner.

17. In a coupled cavity travelling wave tube having a cavity located therein and a longitudinal axis, a coupling plate defining an end of said cavity and acting as a magnetic pole piece, comprising a pair of coaxial discs made of ferro-magnetic material spaced along said longitudinal axis, said discs having radially extending portions with facing inner surfaces and axially extending portions forming a drift tube, said ferro-magnetic material having a given heat conductivity; and an inner member interposed between the radially extending portions of said coaxial discs and having a circumferentially extending arcuate slot therein, said spaced coaxial discs defining radially extending sides of said slot thereby forming a channel in said inner member for the passage of a coolant, said inner member being made of a material resistant to coolant-induced corrosion and having a heat conductivity greater than that of said ferro-magnetic material.

18. In a coupled cavity travelling wave tube, the coupling plate claimed in claim 17 which further comprises a heat conducting disc interposed between at least one of said coaxial ferro-magnetic discs and said inner member, said heat conducting disc having a heat conductivity greater than that of said ferro-magnetic material.

19. In a coupled cavity travelling wave tube, the coupling plate claimed in claim 17 which further comprises a cylindrical heat conducting liner secured to the axially extending portions of said coaxial discs.

20. In a coupled cavity travelling wave tube, the coupling plate claimed in claim 19 wherein said inner member extends through said heat conducting liner thereby dividing said liner into first and second axially separated parts.

* * * * *